US008881697B2

(12) United States Patent
Noguchi et al.

(10) Patent No.: US 8,881,697 B2
(45) Date of Patent: Nov. 11, 2014

(54) VALVE TIMING CONTROL APPARATUS

(75) Inventors: Yuji Noguchi, Obu (JP); Atsushi Homma, Kariya (JP); Takeo Asahi, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 826 days.

(21) Appl. No.: 12/955,352

(22) Filed: Nov. 29, 2010

(65) Prior Publication Data

US 2011/0168112 A1 Jul. 14, 2011

(30) Foreign Application Priority Data

Jan. 8, 2010 (JP) ..... 2010-003156

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 2001/0476* (2013.01)
USPC ..... 123/90.17

(58) Field of Classification Search
USPC ..... 123/90.15, 90.17; 464/160, 161
See application file for complete search history.

(56) References Cited

U.S. PATENT DOCUMENTS 6,176,210 B1 1/2001 Lichti et al.
6,374,786 B1 * 4/2002 Ogawa ..... 123/90.17
6,779,500 B2 * 8/2004 Kanada et al. ..... 123/90.17
7,401,582 B2 * 7/2008 Pierik et al. ..... 123/90.17
2002/0062802 A1 * 5/2002 Saito et al. ..... 123/90.17
2009/0145386 A1 6/2009 Ushida
2009/0183702 A1 * 7/2009 Knecht et al. ..... 123/90.15
2009/0199799 A1 * 8/2009 Ikihara ..... 123/90.17

FOREIGN PATENT DOCUMENTS

DE 10 2008 029 692 A1 1/2010
DE 10 2008 031 119 A1 1/2010
JP 2009-138611 A 6/2009

OTHER PUBLICATIONS

European Search Report dated May 6, 2011, issued by the European Patent Office in corresponding European Patent Application No. 10 01 5284.

* cited by examiner

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A valve timing control apparatus includes a drive-side rotation member synchronously rotating with a crankshaft of an internal combustion engine, a driven-side rotation member integrally rotating with a camshaft, a rotational phase adjusting device including a retarded angle chamber and an advanced angle chamber, the rotational phase adjusting device adjusting the relative rotational phase between the drive-side rotation member and the driven-side rotation member, and a boss member provided at a portion of the driven-side rotation member facing an outer wall surface of the internal combustion engine and including a thrust surface that extends to be perpendicular to a rotational axis of the camshaft and that is exposed to the outer wall surface of the internal combustion engine. The boss member causes the drive-side rotation member to be prevented from making contact with the outer wall surface by making contact with the outer wall surface of the internal combustion engine.

19 Claims, 4 Drawing Sheets

VALVE TIMING CONTROL APPARATUS

CROSS REFERENCE TO RELATED APPLICATIONS

This application is based on and claims priority under 35 U.S.C. §119 to Japanese Patent Application 2010-003156, filed on Jan. 8, 2010, the entire content of which is incorporated herein by reference.

TECHNICAL FIELD

This disclosure relates to a valve timing control apparatus.

BACKGROUND DISCUSSION

A technique for supporting a valve timing control apparatus is disclosed in U.S. Pat. No. 6,176,210B1 (hereinafter referred to as Reference 1). The valve timing control apparatus disclosed in Reference 1 includes a drive-side rotation member integrally rotating with a sprocket to which a rotational driving force of a crankshaft is transmitted via a chain. A bearing portion is integrally formed at the drive-side rotation member. The valve timing control apparatus also includes a driven-side rotation member of which a rotational phase relative to the drive-side rotation member is changed by a control of operation oil. A boss (i.e., a member having a journal at an outer periphery), to which a camshaft is connected, is connected to the driven-side rotation member.

In a case where a surface of the sprocket facing an internal combustion engine (i.e., an engine) is formed to be flat as in Reference 1, the surface may make contact with an outer wall surface of the engine (specifically, a cylinder head) so as to serve as a thrust bearing, thereby supporting the valve timing control apparatus.

A valve timing control apparatus disclosed in JP2009-138611A (hereinafter referred to as Reference 2) includes a drive-side rotation member (i.e., a shoe housing) integrally rotating with a sprocket to which a rotational driving force of a crankshaft is transmitted, and a driven-side rotation member (i.e., a vane rotor) of which a rotational phase relative to the drive-side rotation member is changed by a control of operation oil. The driven-side rotation member is connected to a camshaft.

According to Reference 2, a portion of the camshaft is radially enlarged to form a stepped portion that makes contact with an outer surface of an engine head so that the stepped portion serves as a thrust bearing for supporting the valve timing control apparatus.

The camshaft may be supported in a slightly movable manner relative to an outer wall of an internal combustion engine (i.e. an outer wall of a cylinder head) in a direction along a rotational axis of the camshaft. In a case where the camshaft moves towards the engine, the sprocket makes contact with an outer wall surface of the engine according to the valve timing control apparatus disclosed in Reference 1.

Accordingly, in a case where a wide surface of such sprocket makes contact with the outer wall surface of the engine, the sprocket or the chain may become worn or an abnormal sound may be generated by the contact of the sprocket relative to the outer wall surface of the engine. In addition, when the sprocket or the chain makes contact with the outer wall surface of the engine (cylinder head), a frictional force therefrom directly acts on the crankshaft, which may cause a timing delay of control of the rotational phase of the valve timing control apparatus.

Then, according to Reference 2, a large diameter portion of the camshaft makes contact with the outer wall surface of the engine so that the sprocket or the chain is positively separated from the outer wall of the engine. Alternatively, a reduction of a contact area of the sprocket or the chain relative to the outer wall surface of the engine may be considered. However, in case of processing the camshaft, the process may take more time and be complicated.

Further, in the same way as the large diameter portion of the camshaft in Reference 2, a portion of the driven-side rotation member in the vicinity of a rotational axis thereof may be enlarged to form a large diameter portion that protrudes towards the engine. Then, the large diameter portion makes contact with the outer wall surface of the engine. However, the driven-side rotation member that simply makes contact with the outer wall surface of the engine may cause an abrasion, which leads to a durability issue.

In view of improvement of the durability, a material having a high abrasion resistance may be used for the driven-side rotation member. However, processability and cost may create inconveniences. In addition, in order to improve the abrasion resistance at a portion making contact with the outer wall surface of the engine for improvement of the durability, a surface treatment may be performed on only the contact portion. However, a masking of a range for treatment or a complicated process for the surface treatment may result in less feasibility.

A need thus exists for a valve timing control apparatus which is not susceptible to the drawback mentioned above.

SUMMARY

According to an aspect of this disclosure, a valve timing control apparatus includes a drive-side rotation member synchronously rotating with a crankshaft of an internal combustion engine, a driven-side rotation member arranged to be rotatable relative to the drive-side rotation member and to be coaxial therewith, the driven-side rotation member integrally rotating with a camshaft for opening and closing a valve of the internal combustion engine, a rotational phase adjusting device including a retarded angle chamber and an advanced angle chamber both defined by the drive-side rotation member and the driven-side rotation member, the retarded angle chamber of which a volume increase causes a relative rotational phase of the driven-side rotation member to the drive-side rotation member to move in a retarded angle direction, the advanced angle chamber of which a volume increase causes the relative rotational phase to move in an advanced angle direction, the rotational phase adjusting device adjusting the relative rotational phase between the drive-side rotation member and the driven-side rotation member by a supply and a discharge of an operation oil relative to either the retarded angle chamber or the advanced angle chamber, and a boss member provided at a portion of the driven-side rotation member facing an outer wall surface of the internal combustion engine, the boss member including a thrust surface that extends to be perpendicular to a rotational axis of the camshaft and that is exposed to the outer wall surface of the internal combustion engine. The boss member causes the drive-side rotation member to be prevented from making contact with the outer wall surface by making contact with the outer wall surface of the internal combustion engine.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
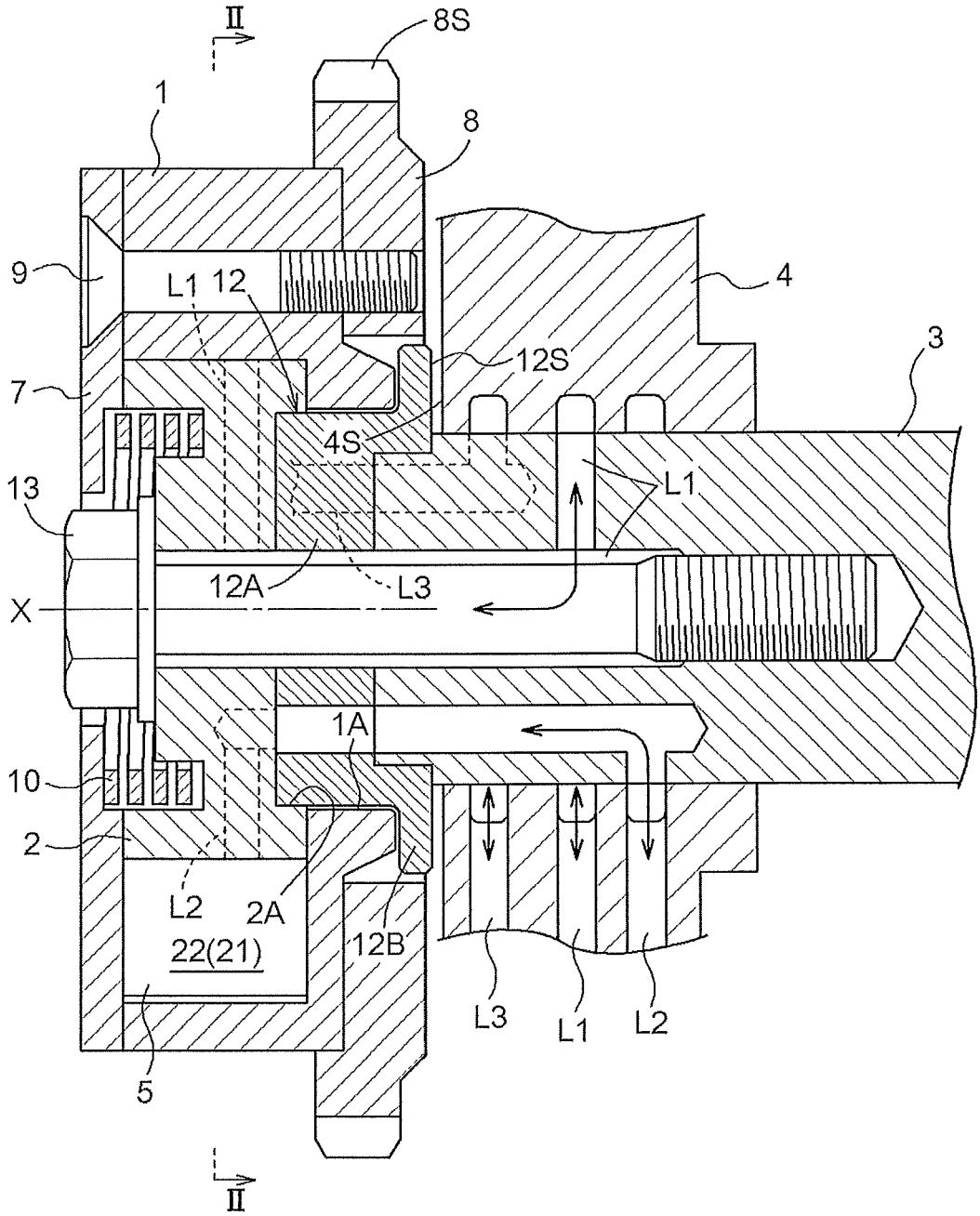
FIG. 1 is a cross-sectional view of a valve timing control apparatus supported by a camshaft according to an embodiment disclosed here.
Figure 2:
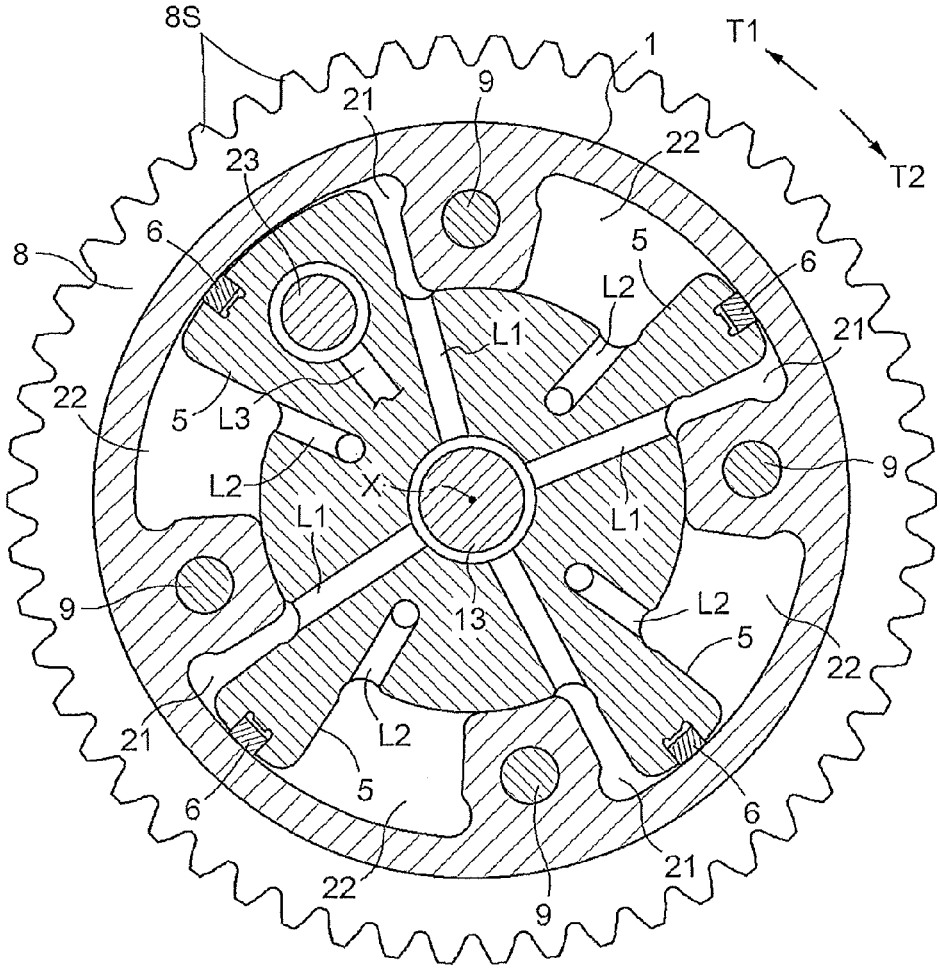
FIG. 2 is a cross-sectional view taken along the line II-II illustrated in FIG. 1.

An embodiment disclosed here will be explained with reference to the attached drawings. As illustrated in FIGS. 1 and 2, a valve timing control apparatus according to the present embodiment includes an outer rotor 1 serving as a drive-side rotation member, an inner rotor 2 serving as a driven-side rotation member, retarded angle chambers 21, and advanced angle chambers 22. The retarded angle chambers 21 and the advanced angle chambers 22 constitute and serve as a rotational phase adjusting device for changing or adjusting a relative rotational phase between the outer rotor 1 and the inner rotor 2 by supply and discharge of an operation oil relative to either the retarded angle chambers 21 or the advanced angle chambers 22 from an electromagnetic control valve. The outer rotor 1 synchronously rotates with a crankshaft of an engine (i.e., an internal combustion engine) via a timing chain. The inner rotor 2 integrally rotates with a camshaft 3 that opens or closes an intake valve or an exhaust valve provided at a combustion chamber of the engine. The inner rotor 2 is coaxial with the camshaft 3.

The camshaft 3 is supported so as to penetrate through a cylinder head 4 of the engine. The valve timing control apparatus is provided at a position adjacent to an outer wall surface 4S of the cylinder head 4.

In the valve timing control apparatus, the inner rotor 2 is fitted to the outer rotor 1 so that the outer rotor 1 and the inner rotor 2 are rotatable relative to each other about a rotational axis X within a predetermined range of a relative rotational phase. Hydraulic chambers are defined between the outer rotor 1 and the inner rotor 2. Specifically, each of the hydraulic chambers is divided into the retarded angle chamber 21 and the advanced angle chamber 22 by means of a vane 5 that is arranged within the hydraulic chamber so as to extend radially outward from the inner rotor 2.

As illustrated in FIG. 2, a seal 6 is arranged at a radially end portion of each of the vanes 5 so as to be slidable with an inner peripheral surface of the hydraulic chamber. Thus, in a case where the outer rotor 1 and the inner rotor 2 rotate relative to each other, the seal 6 arranged at the radially end portion of each of the vanes 5 restrains a direct flow of operation oil between the retarded angle chamber 21 and the advanced angle chamber 22 by sliding relative to the inner peripheral surface of the hydraulic chamber. In addition, a lock member 23 is provided at one of the vanes 5 so as to be movable in a direction in parallel to the rotational axis X. The lock member 23 is biased by a spring in a projecting manner. The lock member 23 is brought in a locked state by engaging with a lock recess portion provided at the outer rotor 1 by means of a biasing force of the spring while the outer rotor 1 and the inner rotor 2 are positioned in a predetermined relative rotational phase. As a result, the relative rotation between the outer rotor 1 and the inner rotor 2 is prohibited.

A first oil passage L1 for supplying and discharging the operation oil relative to the retarded angle chamber 21, a second oil passage L2 for supplying and discharging the operation oil relative to the advanced angle chamber 22, and a third oil passage L3 for unlockinging the lock member 23 are formed at the inner rotor 2. Specifically, each of the first, second, and third oil passages L1, L2, and L3 is formed by penetrating through the inner rotor 2, a boss member 12, the camshaft 3, and the cylinder head 4. Structures of the lock member 23 and the oil passages are known as disclosed in JPH10-212911A, JPH11-81927A, and the like. Therefore, detailed explanations of the three oil passages L1, L2, and L3 formed at the inner rotor 2 will be omitted.

A front plate 7 is arranged at a front side (i.e. a left direction in FIG. 1) of the outer rotor 1 while a rear plate 8 is arranged at a rear side (i.e., a right direction in FIG. 1) of the outer rotor 1 so that the front plate 7 and the rear plate 8 sandwich the outer rotor 1. In the embodiment, front and rear sides of the valve timing control apparatus and components thereof correspond to left and right sides (directions) in FIGS. 1 and 3. The front plate 7, the rear plate 8, and the outer rotor 1 are connected and fixed to one another by a fixing bolt 9. A timing sprocket 8S is integrally formed at an outer periphery of the rear plate 8. A timing chain is disposed between the timing sprocket 8S and a sprocket attached to the crankshaft of the engine.

A return spring 10 is disposed between the outer rotor 1 and the inner rotor 2 while exercising a biasing force in a circumferential direction of the inner rotor 2. The return spring 10 biases the inner rotor 2 until the inner rotor 2 reaches a predetermined rotational phase at the advanced angle side from the retarded angle side. In a case where the inner rotor 2 is positioned in a range beyond the predetermined rotational phase to the advanced angle side, the return spring 10 is prevented from biasing the inner rotor 2. A torsion spring or a spiral spring is used as the return spring 10.

Figure 3:
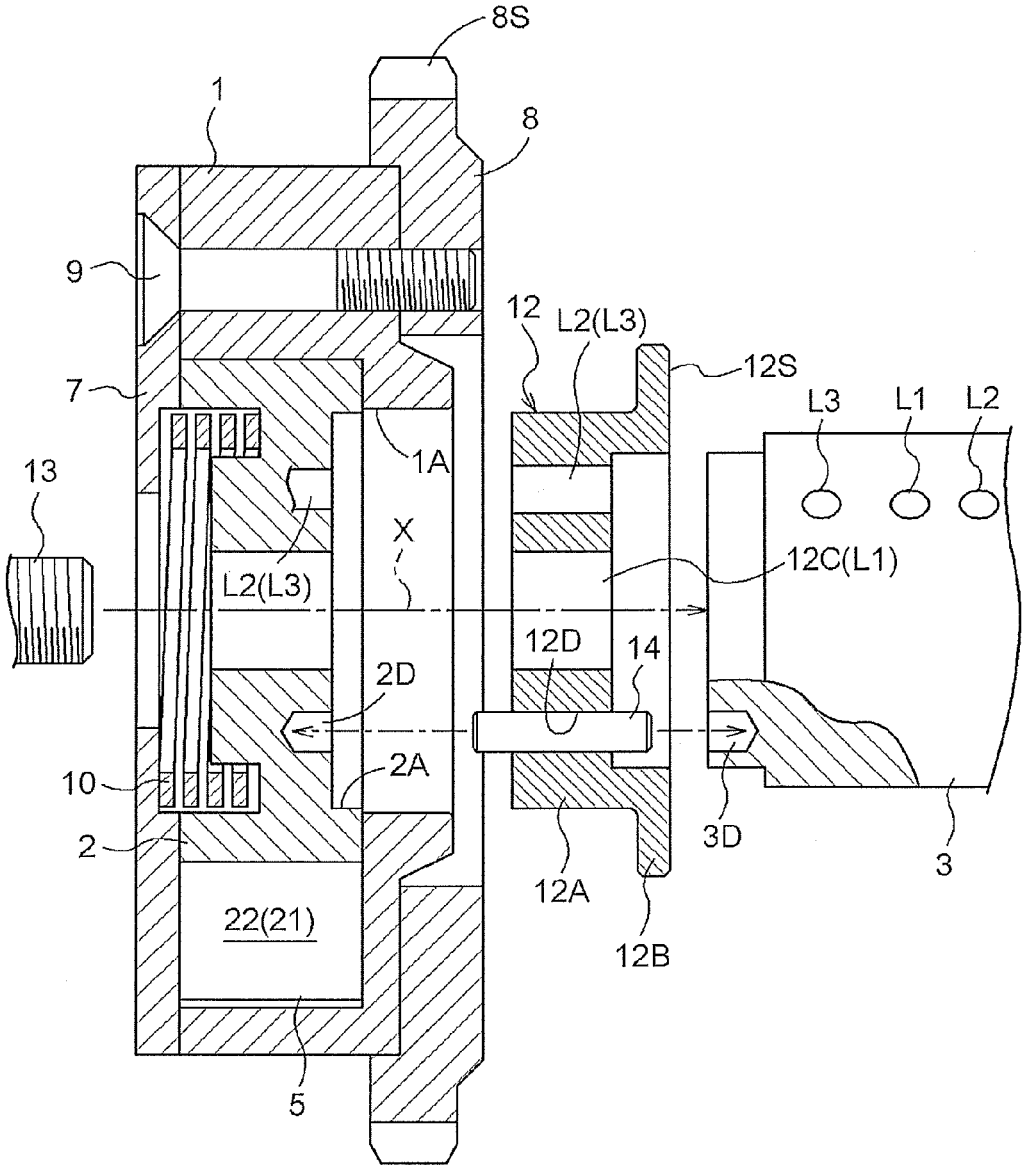
FIG. 3 is a cross-sectional view of the valve timing control apparatus in an exploded state.
Figure 4:
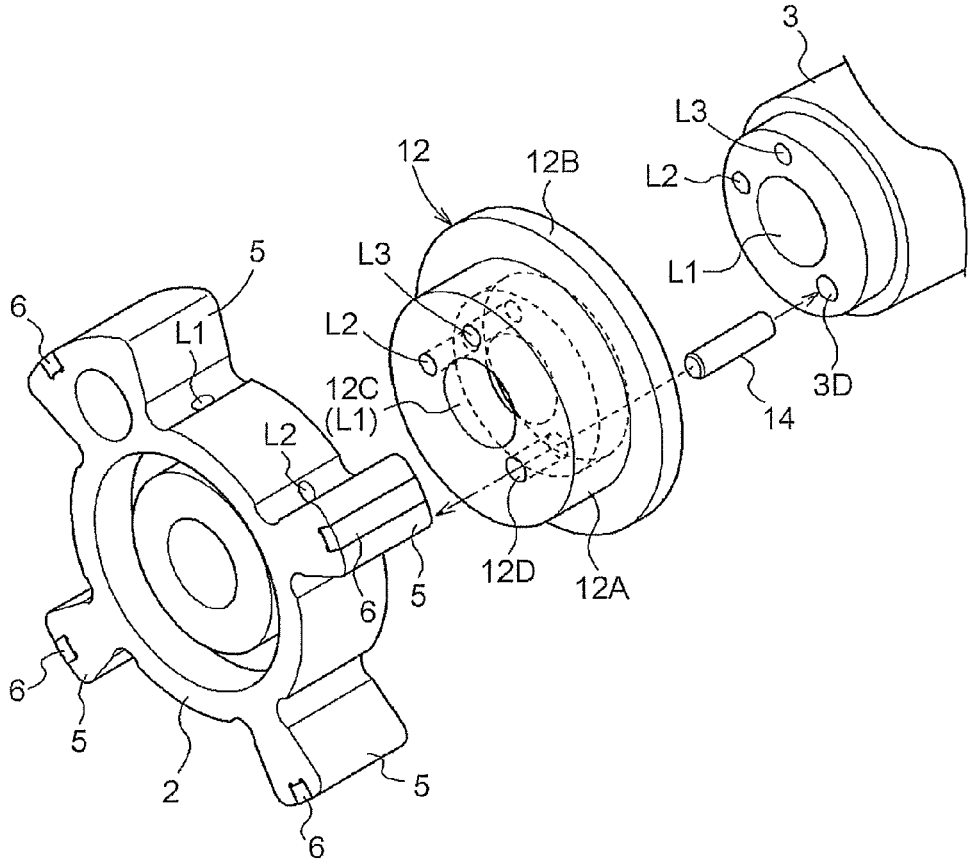
FIG. 4 is a perspective exploded view of a vane and a boss member of the valve timing control apparatus.

As illustrated in FIGS. 1 and 3, a recess 2A is formed at a rear surface of the inner rotor 2 while having a cylindrical inner periphery about the rotational axis X. The boss member 12 is fitted to the recess 2A. The boss member 12 is made by a material having a high abrasion resistance such as a sintered metal. Then, as further illustrated in FIG. 4, the boss member 12 includes a body 12A having a column shape and a disc-shaped portion 12B integrally formed at a rear end of the body 12A. The boss member 12 further includes a through hole 12C at a center so that a connection bolt 13 is inserted thereto. A thrust surface 12S is formed at a rear end of the disc-shaped portion 12B. The thrust surface 12S having a flat and smooth shape is formed to extend in a direction perpendicular to the rotational axis X.

An opening 1A into which the boss member 12 is inserted is formed at a rear end of the outer rotor 1 so as to have a circular shape about the rotational axis X. Dimensions of the opening 1A and the boss member 12 are defined in such a manner that the relative rotation between the outer rotor 1 and the boss member 12 is allowed in a state where an outer periphery of the body 12A of the boss member 12 is slightly in contact with an inner peripheral surface of the outer rotor 1 at the rear end that defines the opening 1A.

The first, second, and third oil passages L1, L2, and L3 formed at the inner rotor 2 are connected to the first, second, and third oil passages L1, L2, and L3 formed at the camshaft 3 via oil passages obtained by through holes that are formed at the boss member 12, such as the through hole 12C. In order to maintain relative positions between the oil passages formed at the inner rotor 2, the boss member 12, and the camshaft 3, a fitting bore 12D is formed at the body 12A of the boss member 12 so as to extend in parallel to the rotational axis as illustrated in FIG. 3. In addition, a fitting bore 3D is formed at an end surface of the camshaft 3 so as to face the fitting bore 12D of the boss member 12. Further, a fitting bore 2D is formed at the recess 2A of the inner rotor 2 so as to face the fitting bore 12D of the boss member 12. Then, a fitting pin (pin) 14 serving as a phase determining device is fitted to the fitting bores 12D, 3D, and 2D of the boss member 12, the camshaft 3, and the inner rotor 2 respectively.

As illustrated in FIG. 1, the first oil passage L1, the second oil passage L2, and the third oil passage L3 are also formed at the cylinder head 4 so as to be connected to the electromagnetic control valve. Oil passage bores, connected to the first, second and third oil passages L1, L2, and L3 of the cylinder head 4 respectively, are formed at an outer peripheral surface of the camshaft 3.

A bolt insertion bore is formed at the camshaft 3 so as to be coaxial with the rotational axis X. The bolt insertion bore is configured in such a manner that an inner diameter of an end portion (i.e., a portion close to the boss member 12) of the bolt insertion bore is enlarged to be greater than an outer diameter of the connection bolt 13. As a result, the bolt insertion bore also serves as the first oil passage L1 of the camshaft 3. In the camshaft 3, the second and third oil passages L2 and L3 are also formed to be connected to respective oil passage bores formed at an end surface of the camshaft 3.

An inner diameter of the through hole 12C of the boss member 12 is enlarged to be greater than the outer diameter of the connection bolt 13 so that the through hole 12C serves as the first oil passage L1. In addition, the second oil passage L2 is formed at the boss member 12 to connect the second oil passage L2 formed at the inner rotor 2 and the second oil passage L2 formed at the camshaft 3. Further, the third oil passage L3 is formed at the boss member 12 to connect the third oil passage L3 formed at the inner rotor 2 and the third oil passage L3 formed at the camshaft 3.

According to the aforementioned configuration, in a state where the valve timing control apparatus is assembled so as to be connected and fixed to the camshaft 3 by means of the connection bolt 13, the fitting bore 2D of the inner rotor 2, the fitting bore 12D of the boss member 12, and the fitting bore 3D of the camshaft 3 are maintained in a predetermined rotational phase relationship by means of the fitting pin 14 that penetrates through the fitting bores 2D, 12D and 3D. In addition, in a state where the valve timing control apparatus is assembled, the thrust surface 12S of the boss member 12 protrudes slightly further towards the cylinder head 4 than a surface of the rear plate 8 facing the cylinder head 4 (i.e., a rear surface of the rear plate 8). Then, in a state where the valve timing control apparatus is connected and fixed to the camshaft 3 by the connection bolt 13, a small clearance is formed between the thrust surface 12S of the boss member 12 and the outer wall surface 4S of the cylinder head 4.

Further, when the valve timing control apparatus is connected and fixed to the camshaft 3, the first oil passages L1 of the inner rotor 2, the boss member 12, and the camshaft 3 respectively, are connected to one another, the second oil passages L2 of the inner rotor 2, the boss member 12, and the camshaft 3 respectively, are connected to one another, and the third oil passages L3 of the inner rotor 2, the boss member 12, and the camshaft 3 respectively are connected to one another.

According to the aforementioned embodiment, the bolt insertion bore of the camshaft 3 functions as the first oil passage L1. Alternatively, an oil passage may be formed at the camshaft 3 so as to serve as the first oil passage L1. The second and third oil passages L2 and L3 may be formed at appropriate or arbitrary positions.

In a case where the operation oil is supplied to the retarded angle chambers 21 through the first oil passages L1 of the cylinder head 4, the camshaft 3, the boss member 12, and the inner rotor 2, by the control of the electromagnetic control valve in an operation state of the engine, a volume of each of the retarded angle chambers 21 is enlarged because of a pressure acting on each of the vanes 5. Thus, the operation oil is discharged through the second oil passages L2 of the inner rotor 2, the boss member 12, the camshaft 3, and the cylinder head 4. As a result, the inner rotor 2 moves in a direction indicated by an arrow T1 in FIG. 2 (i.e., in a retarded angle direction) relative to the outer rotor 1.

On the other hand, in a case where the operation oil is supplied to the advanced angle chambers 22 via the second oil passages L2 of the cylinder head 4, the camshaft 3, the boss member 12, and the inner rotor 2, by the control of the electromagnetic control valve, the volume of each of the advanced angle chambers 22 is enlarged by the pressure acting on each of the vanes 5. As a result, the inner rotor 2 moves in a direction indicated by an arrow T2 in FIG. 2 (i.e., in an advanced angle direction) relative to the outer rotor 1. Accordingly, the rotational phase of the camshaft 3 relative to that of the crankshaft is changed to thereby control the opening and closing timing of the intake valve or the exhaust valve.

The lock member 23 has a function to lock or restrict the outer rotor 1 and the inner rotor 2 at the predetermined relative rotational phase (i.e., the outer rotor 1 and the inner rotor 2 are in a locked state) in a case where the pressure of the operation oil is unstable immediately after the start of the engine. Consequently, the rotational phase of the camshaft 3 relative to that of the crankshaft is maintained at a phase appropriate to the engine start to thereby achieve the stable rotation of the engine. The aforementioned locked state of the outer rotor 1 and the inner rotor 2 is obtained by a drain of the operation oil at the third oil passages L3.

Once the rotation of the engine is stabilized after the engine start, the lock member 23 is dislocated from the lock recess portion of the outer rotor 1 by the supply of the operation oil to the third oil passages L3, thereby releasing the locked state of the outer rotor 1 and the inner rotor 2.

Specifically, in a case where the camshaft 3 is displaced towards the cylinder head 4 (i.e., in a direction pulled to an inside of the cylinder head 4), the thrust surface 12S of the boss member 12 makes contact with the outer wall surface 4S of the cylinder head 4, thereby restraining the displacement of the camshaft 3 as in the same way as a thrust bearing. In such state that the thrust surface 12S of the boss member 12 is in contact with the outer wall surface 4S of the cylinder head 4, the rear plate 8 or the timing chain is prevented from making contact with the outer wall surface 4S. Accordingly, the abrasion of the rear plate 8 or the timing chain, a generation of abnormal noise, and the like may be appropriately restrained. In addition, an operation responsiveness of the valve timing control apparatus may be prevented from deteriorating. Further, a material having a high abrasion resistance is not required for the inner rotor 2, which leads to a reduction of cost and an easy process of the inner rotor 2.

As mentioned above, the valve timing control apparatus includes a structure to sandwich the outer rotor 1 and the inner rotor 2 by the front plate 7 and the rear plate 8. The supply of the operation oil to the hydraulic chambers defined between the outer rotor 1 and the inner rotor 2 is conducted in association with the leakage of the operation oil. Therefore, even when the boss member 12 is displaced towards the cylinder head 4 so that the thrust surface 12S of the boss member 12 makes contact with the outer wall surface 4S of the cylinder head 4, the operation oil leaking from the valve timing control apparatus is supplied as a lubrication oil to flow between the thrust surface 12S and the outer wall surface 4S of the cylinder head 4, thereby further improving durability of the valve timing control apparatus.

According to the aforementioned embodiment, the single fitting pin, i.e., the fitting pin 14 is fitted to the inner rotor 2, the boss member 12 and the camshaft 3 to determine the relative position therebetween. Thus, when comparing a case where a fitting structure including a spline-shaped member or the like is used, for example, the process is simplified while securing the connection of each of the three oil passages L1, L2, and L3.

The aforementioned embodiment may be modified as follows. That is, instead of the single fitting pin 14, a pin for determining the relative position between the inner rotor 2 and the boss member 12, and another pin for determining the relative position between the boss member 12 and the camshaft 3 may be used as the phase determining device. The number of pins may be two or more.

In addition, as the phase determining device, a fitting structure constituted by a rectangular hole and a rectangular column may be provided for determining the relative position between the inner rotor 2 and the boss member 12. The similar fitting structure may be provided for determining the relative position between the boss member 12 and the camshaft 3.

The electromagnetic control valve may be provided at an outside of the cylinder head 4 to thereby achieve a reduction of the number of oil passages formed between the cylinder head 4 and the camshaft 3 or an omission of the oil passages. As a result, the configuration of the boss member 12 may be simplified.

According to the aforementioned embodiment, as long as a portion of the outer wall surface 4S of the cylinder head 4 facing the boss member 12 protrudes towards the boss member 12, the thrust surface 12S of the boss member 12 does not necessarily protrude relative to the timing sprocket 8S towards the outer wall surface 4S of the cylinder head 4. That is, the thrust surface 12S and a surface of the timing sprocket 8S (or the rear plate 8) facing the boss member 12 (i.e., a rear surface of the timing sprocket 8S) may be coplanar with each other or the rear surface of the timing sprocket 8S (or the rear plate 8) may protrude relative to the thrust surface 12S towards the cylinder head 4. According to such configuration, in a case where the camshaft 3 is displaced in the direction towards the cylinder head 4 (i.e., in the direction to be pulled to the inside of the cylinder head 4), the thrust surface 12S of the boss member 12 makes contact with the outer wall surface 4S of the cylinder head 4.

According to the aforementioned embodiment, in a case where the camshaft 3 is displaced towards the inside of the cylinder head 4 (the internal combustion engine), the thrust surface 12S having a flat and smooth shape makes contact with the outer wall surface 4S of the cylinder head 4 (the internal combustion engine). Thus, the abrasion of the timing sprocket 8S, the generation of abnormal noise, and the like that may be caused by a case where the timing sprocket 8S formed at the inner rotor 2 makes contact with the outer wall surface of the internal combustion engine, for example, may be appropriately restrained. In addition, a reduction of responsiveness of the rotational phase control caused by a rotation resistance because of the contact of the timing sprocket 8S with the outer wall surface 4S of the cylinder head 4 (the internal combustion engine) may be avoidable. Further, when comparing cases where a material having a high abrasion resistance is used for the boss member 12 and where the material having the high abrasion resistance is used for the inner rotor 2, the first case is most appropriate for a cost decrease while enhancing the durability. Therefore, even when the valve timing control apparatus makes contact with the outer surface of the engine, the rotational phase control is prevented from deteriorating, thereby achieving the smooth support of the valve timing control apparatus relative to the engine.

The inner rotor 2 includes the recess 2A at a portion facing the outer wall surface 4S of the cylinder head 4, the recess 2A being formed around the rotational axis X of the camshaft 3, and the boss member 12 is fitted to the recess 2A.

Accordingly, the boss member 12 is fitted and fixed to the inner rotor 2 so as to be easily integrally provided therewith.

The valve timing control apparatus further includes the phase determining device (the fitting pin 14) that prevents the relative rotation between the boss member 12 and the camshaft 3.

Accordingly, because of the phase determining device (the fitting pin 14), the relative rotation between the boss member 12 and the inner rotor 2 is prevented. For example, in a case where the oil passage for supplying and discharging the operation oil relative to the retarded angle chamber 21 or the advanced angle chamber 22 is formed at the boss member 12, the oil passage formed at the boss member 12 is securely connected to the oil passage formed at the inner rotor 2. The stable supply and discharge of the operation oil is obtained.

The phase determining device includes the fitting pin 14 fitted to the fitting bore 2D formed at the inner rotor 2 and the fitting bore 12D formed at the boss member 12.

Accordingly, a simplified structure where the pin is inserted into the fitting bores formed at the inner rotor 2 and the boss member 12 respectively, achieves a restraint of the relative rotation between the inner rotor 2 and the boss member 12.

The outer rotor 1 includes the timing sprocket 8S to which a power is transmitted from the engine (the cylinder head 4), and the boss member 12 is provided at a portion closer to the rotational axis X of the camshaft 3 relative to the timing sprocket 8S.

The boss member 12 includes the body 12A having a column shape and the disc-shaped portion 12B formed closer to the camshaft 3 in an axial direction thereof relative to the body 12A, and the thrust surface 12S is formed at the disc-shaped portion 12B.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising:

a drive-side rotation member synchronously rotating with a crankshaft of an internal combustion engine;

a driven-side rotation member arranged to be rotatable relative to the drive-side rotation member and to be coaxial therewith, the driven-side rotation member integrally rotating with a camshaft for opening and closing a valve of the internal combustion engine;

a rotational phase adjusting device including a retarded angle chamber and an advanced angle chamber both defined by the drive-side rotation member and the driven-side rotation member, the retarded angle chamber of which a volume increase causes a relative rotational phase of the driven-side rotation member to the drive-side rotation member to move in a retarded angle direction, the advanced angle chamber of which a volume increase causes the relative rotational phase to move in an advanced angle direction, the rotational phase adjusting device adjusting the relative rotational phase between the drive-side rotation member and the driven-side rotation member by a supply and a discharge of an operation oil relative to either the retarded angle chamber or the advanced angle chamber; and a boss member provided at a portion of the driven-side rotation member facing an outer wall surface of the internal combustion engine, the boss member including a thrust surface that extends to be perpendicular to a rotational axis of the camshaft and that is exposed to the outer wall surface of the internal combustion engine, the boss member causing the drive-side rotation member to be prevented from making contact with the outer wall surface by making contact with the outer wall surface of the internal combustion engine, wherein the thrust surface of the boss member is arranged to face the outer wall surface of the internal combustion engine in a state where the thrust surface is away from the outer wall surface by a predetermined distance in a direction parallel to the rotational axis of the camshaft, and wherein the boss member corresponds to a separate member from the driven-side rotation member and the boss member is made of material including a higher abrasion resistance than an abrasion resistance of material of the driven-side rotation member.

2. The valve timing control apparatus according to claim 1, wherein the driven-side rotation member includes a recess at a portion facing the outer wall surface of the internal combustion engine, the recess being formed around the rotational axis of the camshaft, and the boss member is fitted to the recess.

3. The valve timing control apparatus according to claim 1, further comprising a phase determining device that prevents a relative rotation between the boss member and the camshaft.

4. The valve timing control apparatus according to claim 2, further comprising a phase determining device that prevents a relative rotation between the boss member and the camshaft.

5. The valve timing control apparatus according to claim 3, wherein the phase determining device includes a pin fitted to a fitting bore formed at the driven-side rotation member and a fitting bore formed at the boss member.

6. The valve timing control apparatus according to claim 4, wherein the phase determining device includes a pin fitted to a fitting bore formed at the driven-side rotation member and a fitting bore formed at the boss member.

7. The valve timing control apparatus according to claim 1, wherein the drive-side rotation member includes a timing sprocket to which a power is transmitted from the internal combustion engine, and the boss member is provided at a portion closer to the rotational axis of the camshaft relative to the timing sprocket.

8. The valve timing control apparatus according to claim 2, wherein the drive-side rotation member includes a timing sprocket to which a power is transmitted from the internal combustion engine, and the boss member is provided at a portion closer to the rotational axis of the camshaft relative to the timing sprocket.

9. The valve timing control apparatus according to claim 3, wherein the drive-side rotation member includes a timing sprocket to which a power is transmitted from the internal combustion engine, and the boss member is provided at a portion closer to the rotational axis of the camshaft relative to the timing sprocket.

10. The valve timing control apparatus according to claim 4, wherein the drive-side rotation member includes a timing sprocket to which a power is transmitted from the internal combustion engine, and the boss member is provided at a portion closer to the rotational axis of the camshaft relative to the timing sprocket.

11. The valve timing control apparatus according to claim 5, wherein the drive-side rotation member includes a timing sprocket to which a power is transmitted from the internal combustion engine, and the boss member is provided at a portion closer to the rotational axis of the camshaft relative to the timing sprocket.

12. The valve timing control apparatus according to claim 6, wherein the drive-side rotation member includes a timing sprocket to which a power is transmitted from the internal combustion engine, and the boss member is provided at a portion closer to the rotational axis of the camshaft relative to the timing sprocket.

13. The valve timing control apparatus according to claim 1, wherein the boss member includes a body having a column shape and a disc-shaped portion formed closer to the camshaft in an axial direction thereof relative to the body, and the thrust surface is formed at the disc-shaped portion.

14. The valve timing control apparatus according to claim 2, wherein the boss member includes a body having a column shape and a disc-shaped portion formed closer to the camshaft in an axial direction thereof relative to the body, and the thrust surface is formed at the disc-shaped portion.

15. The valve timing control apparatus according to claim 3, wherein the boss member includes a body having a column shape and a disc-shaped portion formed closer to the camshaft in an axial direction thereof relative to the body, and the thrust surface is formed at the disc-shaped portion.

16. The valve timing control apparatus according to claim 4, wherein the boss member includes a body having a column shape and a disc-shaped portion formed closer to the camshaft in an axial direction thereof relative to the body, and the thrust surface is formed at the disc-shaped portion.

17. The valve timing control apparatus according to claim 5, wherein the boss member includes a body having a column shape and a disc-shaped portion formed closer to the camshaft in an axial direction thereof relative to the body, and the thrust surface is formed at the disc-shaped portion.

18. The valve timing control apparatus according to claim 6, wherein the boss member includes a body having a column shape and a disc-shaped portion formed closer to the camshaft in an axial direction thereof relative to the body, and the thrust surface is formed at the disc-shaped portion.

19. The valve timing control apparatus according to claim 1, wherein a rear plate is arranged between the drive-side rotation member and the outer wall surface of the internal combustion engine to be provided at the drive-side rotation member, the boss member including a disc-shaped portion arranged to be extended radially outwardly relative to an other portion of the boss member, the thrust surface being formed at the disc-shaped portion, and a portion of the disc-shaped portion at which the thrust surface is formed is arranged at a void between the plate and the outer wall surface of the internal combustion engine in an axial direction of the camshaft.

* * * * *